US007439914B1

(12) United States Patent
Lin et al.

(10) Patent No.: US 7,439,914 B1
(45) Date of Patent: Oct. 21, 2008

(54) ANTENNA UNIT

(75) Inventors: Ching-chi Lin, Tu-Cheng (TW); Jia-hung Su, Tu-Cheng (TW); Kai Shih, Tu-Cheng (TW); Yu-yuan Wu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/790,706

(22) Filed: Apr. 27, 2007

(51) Int. Cl.
*H01Q 1/38* (2006.01)

(52) U.S. Cl. ..... 343/700 MS; 343/749

(58) Field of Classification Search ..... 343/700 MS, 343/749, 702, 795, 803, 819, 722
See application file for complete search history.

(56) References Cited

U.S. PATENT DOCUMENTS 2,967,300 A * 1/1961 Haughawout ..... 343/750
6,337,667 B1 * 1/2002 Ayala et al. ..... 343/795
6,639,564 B2 * 10/2003 Johnson ..... 343/702
6,734,828 B2 * 5/2004 Shor ..... 343/795
6,759,990 B2 * 7/2004 Rossman ..... 343/700 MS
7,292,200 B2 * 11/2007 Posluszny et al. ..... 343/803

* cited by examiner

*Primary Examiner*—Tho G Phan
(74) *Attorney, Agent, or Firm*—Rosenberg, Klein & Lee

(57) ABSTRACT

An antenna unit has a first antenna operating at wireless telecommunication bands and a second antenna operating at wireless local area network bands. The first antenna has a first radiating conductor with a first feeding point defining opposite sides, a second, a third and a fourth radiating conductors extending from both sides of the first radiating conductor. A parasitic element defines opposite ends. One end of the parasitic element confronts the free end of the third radiating conductor. A trap circuit connects the fourth radiating conductor and the parasitic element. A second antenna has a third side, a fourth side and a stair-shape side. The connection of the sides of the second antenna forms a first protrusion with a second feeding point and a second protrusion confronting the first antenna. A slot is opened on the second antenna. A ground portion is spaced from the first radiating conductor and the first protrusion.

19 Claims, 5 Drawing Sheets

ANTENNA UNIT

BACKGROUND OF THE INVENTION

1. Field of the Invention

The invention relates to an antenna unit, and particularly to an antenna unit capable of operating at various wireless communication bands.

2. The Related Art

Recently, a portable electrical device is required to be compact, light, and multi-functional according to a recent demand. Electrical circuits and components built in the mobile communication terminal become smaller and more multi-functional in order to satisfy the above requirement. Also, the requirement is applied to an antenna, which is one of major components of the portable electrical device for wireless communication purpose.

Wireless communication bands include global system for mobile communications (GSM) frequency band about 850 mega-hertz (MHz), extended global system for mobile communications (EGSM) frequency band about 900 MHz, digital cellular system (DCS) frequency band about 1800 MHz, personal conferencing specification (PCS) frequency band about 1900 MHz, wideband code division multiple access (W-CDMA) frequency band about 2100 MHz and wireless fidelity (Wi-Fi) frequency band having 2.4 giga-hertz (GHz) and 5.2 GHz nowadays. Therefore, an antenna capable of operating in various wireless communication bands being mentioned above is a necessary component for the portable electrical device.

SUMMARY OF THE INVENTION

An object of the present invention is to provide an antenna unit obtains various frequency bands capable of operating at wireless telecommunication bands and wireless local area network bands.

According to the invention, the antenna unit has a first antenna and a second antenna spaced from the first antenna. The first antenna has a first radiating conductor defined a first side, a second side opposite to the first side and opposite ends. A second radiating conductor formed as an elongated shape extends from one end of the first side of the first radiating conductor. A third radiating conductor and a fourth radiating conductor formed as an elongated shape extend from both ends of the second side of the first radiating conductor respectively. A parasitic element formed as an elongated shape defines opposite ends, wherein one end of the parasitic element confronts the free end of the third radiating conductor. A first trap circuit connects the fourth radiating conductor and the parasitic element. A feeding point is arranged at one end of the first radiating conductor which is near the fourth radiating conductor. A ground portion is spaced from the first radiating conductor.

When the first antenna is operated at wireless communication, the current is fed to the first feeding point. Therefore, the cooperation of the first radiating conductor and the second radiating conductor obtains an electrical resonance length of a quarter wavelength corresponding to DCS1800 MHz band. The cooperation of the first radiating conductor and the third radiating conductor obtains an electrical resonance length of a quarter wavelength corresponding to PCS1900 MHz band and W-CDMA2100 MHz band. The cooperation of the first radiating conductor, the fourth radiating conductor, the first trap circuit and the parasitic element obtains an electrical resonance length of a quarter wavelength corresponding to GSM850 MHz band and EGSM900 MHz band.

Therefore, the first antenna obtains wireless telecommunication bands including GSM850 MHz band, EGSM900 MHz band, DCS1800 MHz band, PCS1900 MHz band and W-CDMA2100 MHz band.

The second antenna defines a third side, a fourth side connected to the third side and a stair-shape side connected to the third side and the fourth side. The third side and the fourth side are formed as an angle. The stair-shape side, the third side and the fourth side are formed as a first protrusion and a second protrusion. An elongated slot is opened on the central area of the second antenna. A second feeding point is arranged at the first protrusion. The ground portion is spaced from the first protrusion.

When the second antenna is operated at wireless communication, the second antenna obtains wireless local area network bands including Wi-Fi2.4 GHz band and Wi-Fi5.2 GHz band. Therefore, the antenna unit obtains wireless telecommunication bands and wireless local area network bands.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
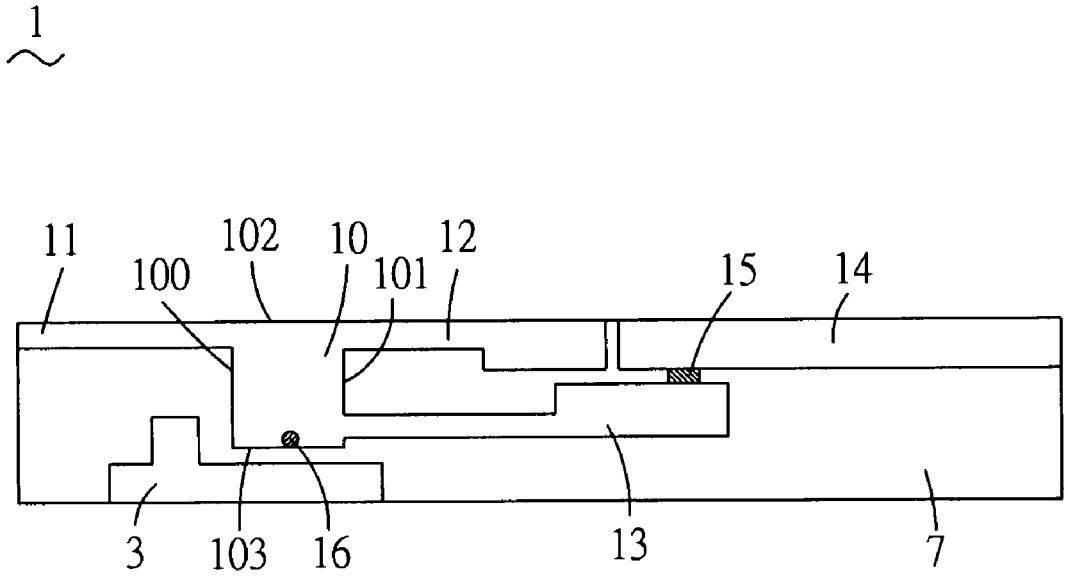
FIG. 1 is a first preferred embodiment showing a first antenna of an antenna unit according to the present invention.
Figure 3:
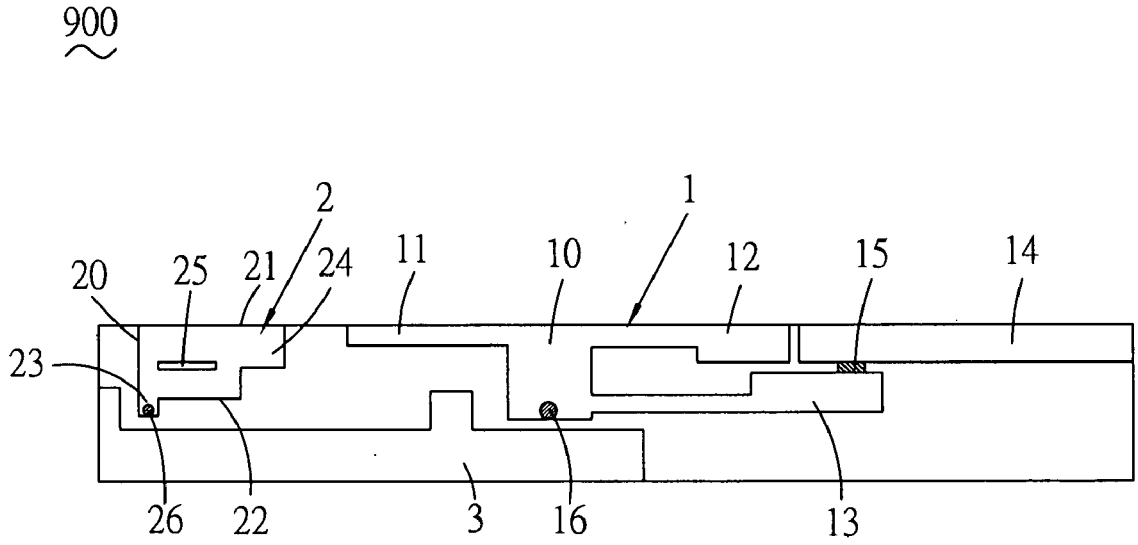
FIG. 3 is a third preferred embodiment showing the cooperation of the first antenna of the antenna unit and a second antenna of the antenna unit according to the present invention.

Please refer to FIG. 3, which shows an antenna unit 900 has a first antenna 1 and a second antenna 2 spaced from the first antenna 1 according to the present invention. Please refer to FIG. 1, which shows a first preferred embodiment of the first antenna 1 of the antenna unit 900 according to the present invention. The first antenna 1 arranged on an insulation material 7 has a first radiating conductor 10 defining a first side 100, a second side 101 opposite to the first side 100, a first end 102 and a second end 103 opposite to the first end 102. A second radiating conductor 11 extends from one end of the first side 100 of the first radiating conductor 10. A third radiating conductor 12 and a fourth radiating conductor 13 extend from both ends of the second side 101 of the first radiating conductor 10 respectively.

In this case, the second radiating conductor 11, the third radiating conductor 12 and the fourth radiating conductor 13 are formed as an elongated shape respectively. The insulation material 7 is an insulation plate. The length of the fourth radiating conductor 13 is longer than the length of the third radiating conductor 12. One side of the second radiating conductor 11, one side of the third radiating conductor 12 and the first end 102 of the first radiating conductor 10 are at the same level. A parasitic element 14 is made of metal material defining opposite ends. One end of the parasitic element 14 confronts the free end of the third radiating conductor 12. In this case, the parasitic element 14 is also formed as an elongated shape.

A first trap circuit 15 electronically connects the fourth radiating conductor 13 and the parasitic element 14. A first feeding point 16 is arranged at the second end 103 of the first radiating conductor 10. In this case, the first feeding conductor 16 is arranged at the central area of the second end 103 of the first radiating conductor 10. A ground portion 3 is spaced from the first radiating conductor 10. In this case, the first radiating conductor 10 of the first antenna 1 is close to the ground portion 3.

When the first antenna 1 of the antenna unit 900 is operated at wireless communication, the current is fed to the first feeding point 16. The current passes through the first radiating conductor 10 and the second radiating conductor 11 to obtain an electrical resonance length of a quarter wavelength corresponding to DCS1800 MHz band. The current passes through the first radiating conductor 10 and the third radiating conductor 12 to obtain an electrical resonance length of a quarter wavelength corresponding to PCS1900 MHz band and W-CDMA2100 MHz band. The current passes through the first radiating conductor 10, the fourth radiating conductor 13, the first trap circuit 15 and the parasitic element 14 to obtain an electrical resonance length of a quarter wavelength corresponding to GSM850 MHz band and EGSM900 MHz band.

In this case, the distance between the third radiating conductor 12 and the fourth radiating conductor 13 keeps an appropriate length for balancing the gain of the GSM850 MHz band and EGSM900 MHz band and the gain of the PCS1900 MHz band and W-CDMA2100 MHz band. When the third radiating conductor 12 is close to the fourth radiating conductor 13, the gain of the PCS1900 MHz band and W-CDMA2100 MHz band is decreased.

Figure 2:
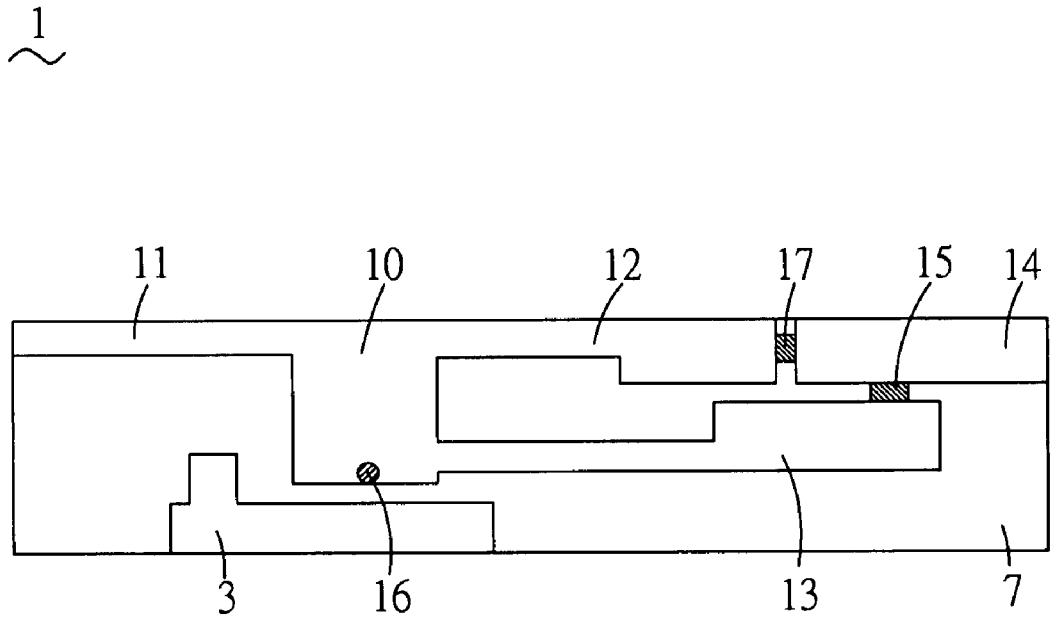
FIG. 2 is a second preferred embodiment illustrating the first antenna of the antenna unit according to the present invention.

Please refer to FIG. 2, which shows a second preferred embodiment of the first antenna 1 of the antenna unit 900. For the downsizing purpose, a second trap circuit 17 electronically connects the third radiating conductor 12 and the parasitic element 14 and the length of the parasitic element 14 is reduced. Therefore, the value of the electrical characteristic of the first trap circuit 15 is adjusted for compensating the electrical characteristic of the reduced portion of the parasitic element 14. In this case, the second trap circuit 17 is arranged between the free end of the third radiating conductor 12 and one end of the parasitic element 14. In this case, the current passes through the first radiating conductor 10 and the second radiating conductor 11 to obtain an electrical resonance length of a quarter wavelength corresponding to DCS1800 MHz band.

The current passes through the first radiating conductor 10 and the third radiating conductor 12 to obtain an electrical resonance length of a quarter wavelength corresponding to PCS1900 MHz band and W-CDMA2100 MHz band. The current passes through the first radiating conductor 10, the fourth radiating conductor 13, the first trap circuit 15 and the parasitic element 14 to obtain an electrical resonance length of a quarter wavelength corresponding to GSM850 MHz band or EGSM900 MHz band. The current passes through the first radiating conductor 10, the third radiating conductor 12, the second trap circuit 17 and the parasitic element 14 to obtain an electrical resonance length of a quarter wavelength corresponding to EGSM900 MHz band or GSM850 MHz band.

Please refer to FIG. 3, which illustrates a third preferred embodiment showing the cooperation of the first antenna 1 and the second antenna 2. The second antenna 2 also arranged on the insulation material 7 defines a third side 20, a fourth side 21 connected to the third side 20 to form as an angle and a stair-shape side 22 connected to the third side 20 and the fourth side 21 to form a first protrusion 23 and a second protrusion 24. An elongated slot 25 is opened on the central area of the second antenna 2. A second feeding point 26 is arranged at the first protrusion 23. The ground portion 3 is spaced from the first protrusion 23. In this case, the first protrusion 23 is close to the ground portion 3.

When the second antenna 2 is operated at wireless communication, the second antenna 2 obtains wireless local area network bands including Wi-Fi2.4 GHz band and Wi-Fi5.2 GHz band. For the purpose of balancing the gain of the first antenna 1 and the gain of the second antenna 2, the second protrusion 24 is arranged to face the free end of the second radiating conductor 11 of the first antenna 1.

Figure 4:
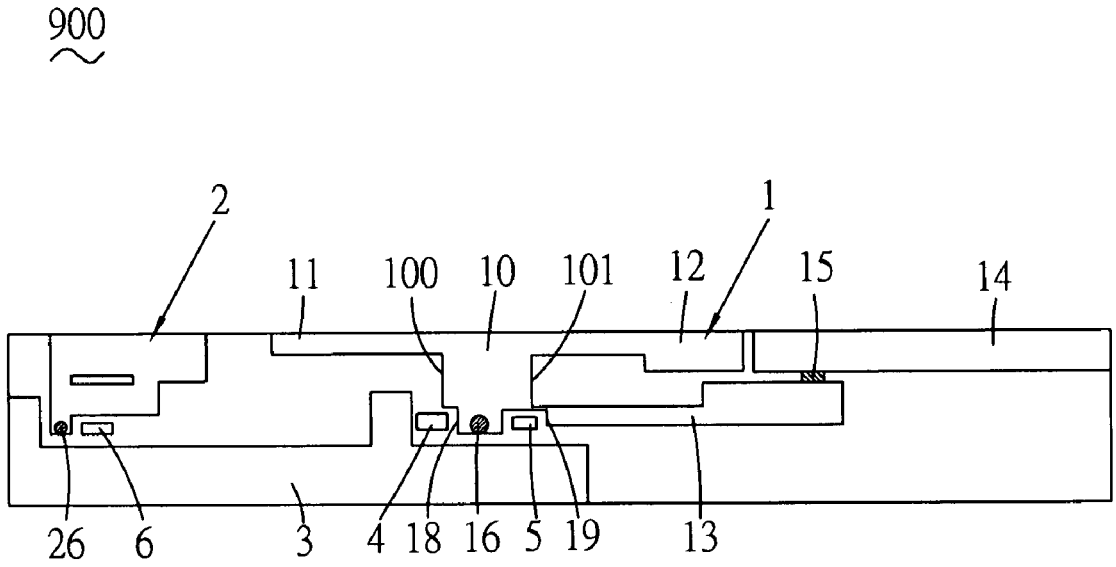
FIG. 4 is a fourth preferred embodiment illustrating the cooperation of the first antenna of the antenna unit and a second antenna of the antenna unit according to the present invention.

Please refer to FIG. 4, which shows a fourth preferred embodiment of the invention. For the downsizing purpose, the first side 100 of the first radiating conductor 10 of the first antenna 1 forms a first concave 18. The second side 101 of the first radiating conductor 10, where the fourth radiating conductor 13 extends forms a second concave 19. A first matching circuit 4 and a second matching circuit 5 are arranged at the first concave 18 and the second concave 19 respectively. The first matching circuit 4 and the second matching circuit 5 respectively electronically connect the first feeding point 16 and the ground portion 3. A third matching circuit 6 spaced from the first protrusion 23 electronically connects the second feeding point 26 and the ground portion 3. In this case, the first concave 18 is close to the first feeding point 16, therefore the first matching circuit 4 electronically contacts the first feeding point 16 conveniently.

Figure 5:
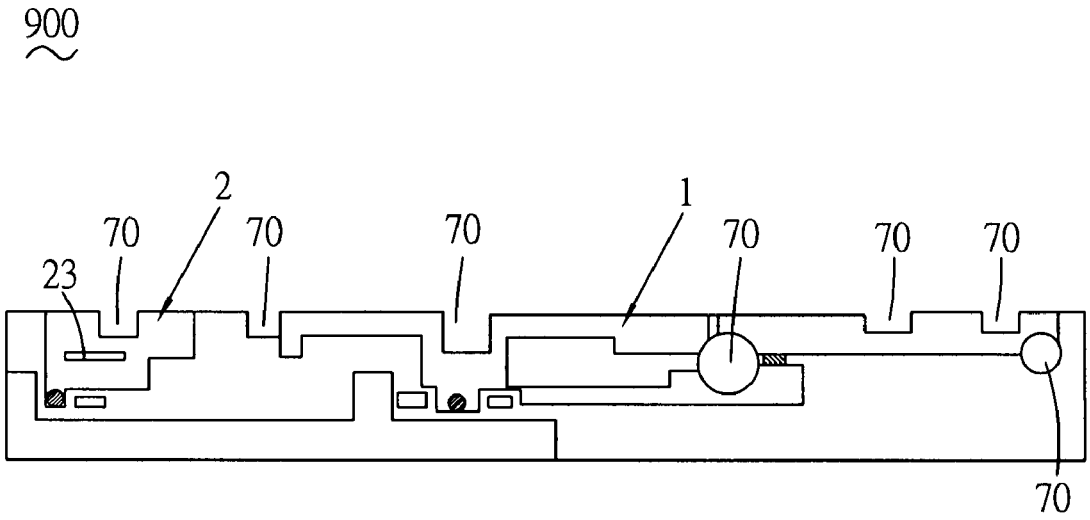
FIG. 5 is a fifth preferred embodiment showing the cooperation of the first antenna of the antenna unit and a second antenna of the antenna unit according to the present invention.

Please refer to FIG. 5, which shows a fifth preferred embodiment of the invention. A plurality of through holes 70 are opened through the first antenna 1, the second antenna 2 and the insulation material 7 for being engaged with a fixing portion of an electrical device (not shown in figures). In this embodiment, the second radiating conductor 11 is formed as a L-shape.

According to the cooperation of the first antenna 1 and the second antenna 2 of the antenna unit 900, the antenna unit 900 can operate at wireless telecommunication bands including GSM850 MHz band, EGSM900 MHz band, DCS1800 MHz band, PCS1900 MHz band and WCDMA2100 MHz band, and wireless local area network bands including Wi-Fi2.4 GHz band and Wi-Fi5.2 GHz band. Additionally, the antenna unit 900 can be configured in the electrical device through the through holes 70.

Furthermore, the present invention is not limited to the embodiments described above; various additions, alterations and the like may be made within the scope of the present invention by a person skilled in the art. For example, respective embodiments may be appropriately combined.

What is claimed is:

1. An antenna unit comprising:

a first antenna having a first radiating conductor defining a first side, a second side opposite to said first side and opposite ends, a second radiating conductor extending from said first side of said first radiating conductor, a third radiating conductor and a fourth radiating conductor extending from both ends of said second side of said first radiating conductor respectively, said second radiating conductor and said third radiating conductor being at the same level, the length of said fourth radiating conductor being longer than the length of said third radiating conductor, a parasitic element defining opposite ends, wherein one end of said parasitic element confronts the free end of said third radiating conductor, a first trap circuit connecting said fourth radiating conductor and said parasitic element, a first feeding point arranged at one end of said first radiating conductor which is near said fourth radiating conductor;

a second antenna spaced from said first antenna, the second antenna having a third side, a fourth side connected to said third side to form an angle, a stair-shape side connecting said third side and said fourth side to form a first protrusion and a second protrusion, a slot opened on the central area of said dual band antenna, a second feeding point arranged at said first protrusion; and a ground portion spaced from said first radiating conductor of said first antenna and said first protrusion of said second antenna.

2. The antenna unit as claimed in claim 1, wherein said second radiating conductor of said first antenna, said third radiating conductor of said first antenna and said fourth radiating conductor of said first antenna are formed as an elongated shape respectively.

3. The antenna unit as claimed in claim 1, wherein said parasitic element of said first antenna is formed as an elongated shape.

4. The antenna unit as claimed in claim 1, further comprising a second trap circuit connecting said third radiating conductor and said parasitic element.

5. The antenna unit as claimed in claim 4, wherein said second trap circuit is arranged between the free end of said third radiating conductor and one end of said parasitic element of said first antenna.

6. The antenna unit as claimed in claim 1, wherein said second protrusion of said second antenna faces the free end of said second radiating conductor.

7. The antenna unit as claimed in claim 1, wherein said slot is formed as an elongated shape.

8. The antenna unit as claimed in claim 1, further comprising a first concave formed at said first side of said first radiating conductor of said first antenna, a first matching circuit arranged at said first concave and connecting said first feeding point and said ground portion.

9. The antenna unit as claimed in claim 1, further comprising a second concave formed at said second side of said first radiating conductor where said fourth radiating conductor extends, a second matching circuit arranged at said second concave and connecting said first feeding point and said ground portion.

10. The antenna unit as claimed in claim 1, wherein a third matching circuit is spaced from said first protrusion of said second antenna and connected to said second feeding point of said second antenna and said ground portion.

11. The antenna unit as claimed in claim 1, wherein said first antenna and said second antenna are arranged on an insulation material, a plurality of through holes are opened through said first antenna, said second antenna and said insulation material.

12. An antenna, comprising:

a first radiating conductor defining a first side, a second side opposite to said first side and opposite ends;

a second radiating conductor extending from said first side of said first radiating conductor;

a third radiating conductor and a fourth radiating conductor extending from both ends of said second side of said first radiating conductor respectively, said second radiating conductor and said third radiating conductor at the same level, the length of said fourth radiating conductor is longer than the length of said third radiating conductor;

a parasitic element defining opposite ends, wherein one end of said parasitic element confronts the free end of said third radiating conductor;

a first trap circuit connecting said fourth radiating conductor and said parasitic element;

a first feeding point arranged at one end of said first radiating conductor which is near said fourth radiating conductor; and a ground portion spaced from said first radiating conductor.

13. The antenna as claimed in claim 12, wherein said second radiating conductor, said third radiating conductor and said fourth radiating conductor are formed as an elongated shape respectively.

14. The antenna as claimed in claim 12, wherein said parasitic element of said first antenna is formed as an elongated shape.

15. The antenna as claimed in claim 12, further comprising a second trap circuit connecting said third radiating conductor and said parasitic element.

16. The antenna as claimed in claim 15, wherein said second trap circuit is arranged between the free end of said third radiating conductor and one end of said parasitic element.

17. The antenna as claimed in claim 12, further comprising a first concave formed at said first side of said first radiating conductor, a first matching circuit arranged at said first concave and connecting said first feeding point and said ground portion.

18. The antenna as claimed in claim 12, further comprising a second concave formed at said second side of said first radiating conductor where said fourth radiating conductor extends, a second matching circuit arranged at said second concave and connecting said first feeding point and said ground portion.

19. The antenna as claimed in claim 12, wherein said antenna is arranged on an insulation material, a plurality of through holes are opened through said antenna and said insulation material.

* * * * *